US008629743B2

(12) United States Patent
Staffas et al.

(10) Patent No.: US 8,629,743 B2
(45) Date of Patent: Jan. 14, 2014

(54) LATCHING APPARATUS AND AN OPERATING MECHANISM WITH SUCH A LATCHING APPARATUS

(71) Applicants: Daniel Staffas, Ludvika (SE); Erik Ladufjall, Ludvika (SE)

(72) Inventors: Daniel Staffas, Ludvika (SE); Erik Ladufjall, Ludvika (SE)

(73) Assignee: ABB Technology AG (CH)

( * ) Notice: Subject to any disclaimer, the term of this patent is extended or adjusted under 35 U.S.C. 154(b) by 0 days.

(21) Appl. No.: 13/929,063

(22) Filed: Jun. 27, 2013

(65) Prior Publication Data

US 2013/0285771 A1 Oct. 31, 2013

Related U.S. Application Data

(63) Continuation of application No. PCT/EP2011/073316, filed on Dec. 20, 2011.

(30) Foreign Application Priority Data

Dec. 29, 2010 (EP) ..... 10197279

(51) Int. Cl.
*H01H 9/20* (2006.01)
*H01H 9/00* (2006.01)

(52) U.S. Cl.
USPC ..... 335/167; 335/172

(58) Field of Classification Search
USPC ..... 335/167, 172, 77, 170
See application file for complete search history.

(56) References Cited

U.S. PATENT DOCUMENTS

| | | | | |
|---|---|---|---|---|
| 1,670,088 | A * | 5/1928 | Walle | 335/73 |
| 3,810,051 | A | 5/1974 | Walker et al. | |
| 4,845,324 | A * | 7/1989 | Martin et al. | 200/400 |
| 5,424,701 | A * | 6/1995 | Castonguay et al. | 335/172 |
| 5,713,459 | A | 2/1998 | Beck et al. | |
| 6,008,459 | A | 12/1999 | Faber et al. | |
| 6,853,277 | B2 * | 2/2005 | Castonguay et al. | 335/172 |
| 2008/0237016 | A1 | 10/2008 | Gibson et al. | |
| 2009/0050605 | A1 | 2/2009 | Ahn | |

FOREIGN PATENT DOCUMENTS

| | | |
|---|---|---|
| EP | 0292841 A2 | 11/1988 |
| EP | 2001031 A1 | 12/2008 |
| EP | 2246869 A1 | 11/2010 |

OTHER PUBLICATIONS

European Search Report Application No. EP 10 19 7279 Completed: May 23, 2011; Mailing Date: Jun. 1, 2011 5 pages.

(Continued)

*Primary Examiner* — Alexander Talpalatski
(74) *Attorney, Agent, or Firm* — St. Onge Steward Johnston & Reens LLC

(57) ABSTRACT

A latching apparatus for an operating mechanism for an electrical switching apparatus includes a first member movable between a first position and a second position, in the first position the first member adapted to lock a drive member of the operating mechanism and a force of the drive member applied to the first member, and in the second position the first member is adapted to release the drive member from the locked position. Guiding means guides the movement of the first member. A trip member is movable between a third position and a fourth position, in the third position the trip member adapted to lock the first member, and in the fourth position the trip member is adapted to release the first member. The guiding means are adapted to guide at least a first portion of the first member in a first direction toward a counter roller.

15 Claims, 7 Drawing Sheets

(56) References Cited

OTHER PUBLICATIONS

International Search Report and Written Opinion of the International Searching Authority Application No. PCT/EP2011/073316 Completed: Mar. 27, 2012; Mailing Date: Apr. 3, 2012 9 pages.

* cited by examiner

LATCHING APPARATUS AND AN OPERATING MECHANISM WITH SUCH A LATCHING APPARATUS

FIELD OF THE INVENTION

The present invention relates to a latching apparatus for an operating mechanism for an electrical switching apparatus, the operating mechanism being operatively connectable to the switching apparatus, the latching apparatus comprising a first member movable between at least one first position and at least one second position, in the first position the first member being adapted to lock a drive member of the operating mechanism in a locked position and a force of the drive member being applied to the first member, and in the second position the first member is adapted to release the drive member from the locked position. The latching apparatus further comprises a counter roller defining a first axis, at least in the first position the first member being adapted to bear against the counter roller, guiding means for guiding the movement of the first member, the guiding means being adapted to guide the movement of the first member in relation to the counter roller, and a trip member movable between at least one third position and at least one fourth position, in the third position the trip member being adapted to lock the first member in the first position, and in the fourth position the trip member is adapted to release the first member from the first position. In the first position the first member is adapted to distribute the force of the drive member, applied to the first member, to a first force component applied to the counter roller and a second force component applied to the trip member. Further, the present invention relates to an operating mechanism for an electrical switching apparatus, the operating mechanism comprising a latching apparatus of the above-mentioned sort.

BACKGROUND OF THE INVENTION

In a power transmission or distribution network, electrical switching apparatuses are incorporated into the network to provide automatic protection in response to abnormal load conditions or to permit opening or closing (switching) of sections of the network. The switching apparatus may therefore be called upon to perform a number of different operations such as interruption of terminal faults or short line faults, interruption of small inductive currents, interruption of capacitive currents, out-of-phase switching or no-load switching, all of which operations are well known to a person skilled in the art.

In switching apparatuses the actual opening or closing operation is carried out by at least two contacts, which are movable in relation one another, where normally one is stationary and the other is mobile. The mobile contact is operated by an operating system which may comprise a latching apparatus, e.g. controlled by an actuator, and a mechanical system, where said mechanical system operatively connects the latching apparatus to the mobile contact of the switching apparatus.

EP 2 001 031-A1 discloses a latch assembly for an electrical switching apparatus operating mechanism.

US 2009/0050605-A1 describes a circuit breaker having an automatic release linkage.

U.S. Pat. No. 6,008,459 discloses a molded plastic current limiting circuit breaker including an operating mechanism and an actuator.

U.S. Pat. No. 5,713,459 describes a roller latching and release mechanism for electrical switching apparatus.

U.S. Pat. No. 3,810,051 discloses a circuit breaker trip and latch mechanism.

EP 2 246 869-A1 discloses a mechanical latching unit for a main drive unit for an electrical switching apparatus. The latching unit comprises a first roller movable between a first position and a second position, in the first position the first roller being adapted to lock a drive tooth of the main drive unit in a locked position and a force of the drive tooth being applied to the first roller. In the second position the first roller is adapted to release the drive tooth from the locked position. The latching unit also comprises a counter roller, and in at least the first position the first roller is adapted to bear against the counter roller. The latching unit further comprises guiding grooves, a carriage and a locking lever for guiding the movement of the first roller. In the first position the first roller is adapted to distribute the force of the drive tooth, applied to the first roller, to a primary force component applied to the counter roller and a secondary force component applied to the carriage.

Requirements for latching apparatuses, especially when used for electrical switching apparatuses, are high reliability, resistance to shock and overload conditions, resistance to large temperature ranges, high repeatability with lowest possible scatter, and short and adjustable reaction time and total mechanical operation time. Typically these requirements and operating conditions imply a complex structure and high quality and consequently costly system designs.

If these latching apparatuses are designed to meet low cost targets usually there have to be compromises in quality and/or performance.

SUMMARY OF THE INVENTION

One object of the present invention is thus to provide an improved latching apparatus. Another object of the present invention is to provide a latching apparatus that has a less complicated structure in relation to prior-art latching apparatuses. A further object of the present invention is to provide a latching apparatus that has high reliability and a short reaction/latching time.

At least one of the above-mentioned objects of the present invention is attained by providing a latching apparatus for an operating mechanism for an electrical switching apparatus, the operating mechanism being operatively connectable to the switching apparatus, the latching apparatus comprising

- a first member movable between at least one first position and at least one second position, in the first position the first member being adapted to lock a drive member of the operating mechanism in a locked position and a force of the drive member being applied to the first member, and in the second position the first member is adapted to release the drive member from the locked position,
- a counter roller defining a first axis, at least in the first position the first member being adapted to bear against the counter roller,
- guiding means for guiding the movement of the first member, the guiding means being adapted to guide the movement of the first member in relation to the counter roller,
- a trip member movable between at least one third position and at least one fourth position, in the third position the trip member being adapted to lock the first member in the first position, and in the fourth position the trip member is adapted to release the first member from the first position, and
- in the first position the first member is adapted to distribute the force of the drive member, applied to the first member, to a first force component applied to the counter roller and a second force component applied to the trip member, wherein when guiding the first member from the first position to the second position, the guiding means are adapted to guide at least a first portion of the first member in a first direction toward the counter roller. The first member should be configured to be guided accordingly.

By the innovative first member and the guiding means of the latching apparatus as defined herein, a less complicated structure of the latching apparatus is attained, and a latching apparatus that has high reliability and a short reaction/latching time is provided. The innovative guiding means and first member provide for that the drive member is released from the locked position after a minimal distance of movement of the first member from the first position, contributing to a short reaction/latching time. The latching apparatus of the present invention uses only one force reduction stage with a minimal number of mechanical parts, whereas in prior-art latching apparatuses two or more force reduction stages are used. Only a small force is required to operate the trip member and move it from the third position to the fourth position in order to release the drive member, whereby the dimensions of an actuator for operating the trip member may be reduced. As a result of the present invention, the second force component applied to the trip member may amount to approximately 1% of the force of the drive member which is applied to the first member, whereby also approximately 1% of the force of the drive member is required to move the trip member, e.g. by means of an actuator. Further, a reduced effort to reset the latching apparatus to its locking position, i.e. when the first member is in the first position, is required, as only the first member and the trip member need to be reset. This allows for a lower scatter in reaction and operation time. By means of the present invention, the first member may be given a shape and design that is robust and resistant to temperature changes and is easily manufactured. By means of the present invention, the design and the performance of the latching apparatus are scaleable and easily adapted to various environments and applications. The first force component may be called a primary force component and the second force component may be called a secondary force component. By means of the present invention, an improved latching apparatus is attained. In EP 2 246 869A1, no part of the main roller, where the main roller bears against the drive tooth and the counter roller in the locked position, is guided in a direction toward the counter roller when the main roller is moved to release the drive tooth from the locked position.

The guiding means may be in the form of at least one guide. The guiding means are adapted to guide the movement of the first member in relation to the counter roller, i.e. the guiding means are arranged such that the first member is movable in relation to the counter roller. The trip member may be movable in relation to the first member between the third position and the fourth position. The trip member may be adapted to be operated by an actuator, e.g. an electrically operated actuator or an electromagnetic actuator, which may have an actuator coil.

Each of the above-mentioned first to fourth positions may be one or a plurality of positions, i.e. one, two or more positions.

The drive member is adapted to be movable in relation to the latching apparatus between at least one locked position and at least one released position. The drive member may be adapted to turn about a pivot axis, and thus, in the first position the first member may be adapted to block or prevent the drive member from turning about the pivot axis. The drive member, which may be in the form of a drive tooth, may be mounted to a drive unit, which in turn may comprise a rotary drive shaft arranged to transmit an actuating movement to the switching apparatus. When the drive member is released, the rotary drive shaft may be allowed to rotate about its axis and thereby transmit an actuating movement to the switching apparatus.

According to an advantageous embodiment of the latching apparatus according to the present invention, when guiding the first member from the first position to the second position, the guiding means are adapted to guide the first portion of the first member in the first direction that is substantially toward the first axis of the counter roller. The first member should be configured to be guided accordingly.

According to another advantageous embodiment of the latching apparatus according to the present invention, when guiding the first member from the first position to the second position, the guiding means are adapted to rotate the first member about an axis of rotation. Said axis of rotation may be substantially parallel to the first axis of the counter roller. Advantageously, the first portion of the first member may define said axis of rotation. A latching apparatus that has high reliability and a short reaction/latching time is thus provided.

According to a further advantageous embodiment of the latching apparatus according to the present invention, when guiding the first member from the first position to the second position, the guiding means are adapted to guide the first portion of the first member in the first direction so that the distance between the first portion of the first member and the first axis is reduced. The first member should be configured to be guided accordingly.

According to another advantageous embodiment of the latching apparatus according to the present invention, when guiding the first member from the first position to the second position, the guiding means are adapted to guide the first portion of the first member in the first direction that is substantially parallel to or substantially the same as the direction of the force of the drive member applied to the first member.

According to yet another advantageous embodiment of the latching apparatus according to the present invention, when guiding the first member from the first position to the second position, the guiding means are adapted to guide the first portion of the first member in the first direction that is substantially parallel to or substantially the same as the direction of the first force component. The first member should be configured to be guided accordingly.

According to still another advantageous embodiment of the latching apparatus according to the present invention, the first member has an outer surface, and the outer surface comprises a first surface portion, wherein when the first member is in the first position, the first surface portion is adapted to bear against the drive member, and the first portion of the first member comprises the first surface portion. By means of this embodiment, the above-mentioned positive effects are further enhanced. Advantageously, the first surface portion may be convex. By this embodiment, an efficient and advantageous contact surface for the drive member is provided, which provides for that the drive member is firmly locked in the locked position and also provides for a fast release of the drive member from the locked position. A latching apparatus that has high reliability and a short reaction/latching time is thus provided.

According to an advantageous embodiment of the latching apparatus according to the present invention, when guiding the first member from the first position to the second position, the guiding means are adapted to guide at least a second portion of the first member in a second direction different from the first direction. The first member should be configured to be guided accordingly. By this embodiment, the movement of the first member from the first position is further improved, and the release of the drive member from the locked position is further improved, contributing to a short reaction/latching time.

According to a further advantageous embodiment of the latching apparatus according to the present invention, when guiding the first member from the first position to the second position, the guiding means are adapted to guide the second portion of the first member in the second direction that is substantially parallel to or substantially the same as the direction of the second force component. By this embodiment, the movement of the first member from the first position is yet further improved, and the release of the drive member from the locked position is yet further improved, contributing to an improved reaction/latching time.

According to another advantageous embodiment of the latching apparatus according to the present invention, the first member has an outer surface which comprises a second surface portion, and when the first member is in the first position the second surface portion is adapted to bear against the counter roller, the second portion of the first member comprising the second surface portion. By means of this embodiment, the above-mentioned positive effects are further enhanced. Advantageously, the second surface portion may be convex. By this embodiment, an efficient and advantageous contact surface between the first member and the counter roller is provided, which provides for an efficient distribution of the force of the drive member to said first and second force components. A latching apparatus that has high reliability and a short reaction/latching time is thus provided.

According to still another advantageous embodiment of the latching apparatus according to the present invention, the trip member is adapted to lock the first member in the first position by bearing against the first member. By this embodiment, the trip member may be efficiently moved from the third position to the fourth position in order to release the first member from the first position.

According to yet another advantageous embodiment of the latching apparatus according to the present invention, the first member has an outer surface which comprises a third surface portion, the trip member being adapted to lock the first member in the first position by bearing against the third surface portion of the first member, and the second portion of the first member comprises the third surface portion. By this embodiment, the movement of the first member from the first position is further improved, and the release of the drive member from the locked position is further improved, contributing to a short reaction/latching time.

According to an advantageous embodiment of the latching apparatus according to the present invention, the guiding means and the first member are configured such that the magnitude of the second force component is less than 10% of the magnitude of the force of the drive member applied to the first member.

According to a further advantageous embodiment of the latching apparatus according to the present invention, the guiding means and the first member are configured such that the magnitude of the second force component is less than 5% of the magnitude of the force of the drive member applied to the first member, preferably less than 2% of the magnitude of the force of the drive member applied to the first member, more preferably, the guiding means and the first member are configured such that the magnitude of the second force component is about 1% of the magnitude of the force of the drive member applied to the first member.

The smaller the magnitude of the second force component in relation to the magnitude of the force of the drive member, the smaller force is required, e.g. by an actuator, to move the trip member to the fourth position and release the first member from the first position, and consequently, a smaller or less strong actuator may be used, which results in a low weight lathing apparatus that is less expensive.

According to another advantageous embodiment of the latching apparatus according to the present invention, the counter roller is rotatable about the first axis. By this embodiment, the movement of the first member from the first position is further improved, and the release of the drive member from the locked position is further improved, contributing to a short reaction/latching time. Further, by this embodiment, a further improved distribution of the force of the drive member to said first and second force components is provided. A latching apparatus that has high reliability and a short reaction/latching time is thus provided.

According to yet another advantageous embodiment of the latching apparatus according to the present invention, the counter roller has a circumferential outer surface, and at least in the first position the first member is adapted to bear against the outer surface of the counter roller.

According to still another advantageous embodiment of the latching apparatus according to the present invention, the guiding means comprise at least one guiding set comprising at least one guiding slot and at least one guiding member engaging the at least one guiding slot, and the at least one guiding slot and the at least one guiding member are movable in relation to one another. By this embodiment, efficient guiding means are provided which further enhance the above-mentioned positive effects. Advantageously, the first member and a housing of the latching apparatus, in relation to which the first member is movable, may be provided with the at least one guiding slot and the at least one guiding member. Advantageously, the guiding means may comprise two guiding sets each comprising at least one guiding slot and at least one guiding member. The latching apparatus may comprise a housing having two opposite walls, between which the first member is at least partially housed. The first housing wall and one side of the first member may then be provided with a first guiding set and the second housing wall and the other side of the first member may be provided with a second guiding set. The guiding member or the guiding slot may have a longitudinal extension in the direction toward the counter roller and/or substantially toward the first axis of the counter roller. By this embodiment, an efficient guiding of the first member is attained.

According to an advantageous embodiment of the latching apparatus according to the present invention, the guiding set comprises two guiding members that are spaced apart. By this embodiment, a further efficient guiding of the first member is attained. The guiding set may comprise two guiding slots that are spaced apart.

According to a further advantageous embodiment of the latching apparatus according to the present invention, the latching apparatus comprises a housing, and the first member is provided with the at least one guiding member and the housing defines the at least one guiding slot. Alternatively, the first member is provided with at least one guiding slot and the housing is provided the at least one guiding member. The housing may comprise two opposite walls between which the first member is provided. The counter roller and/or the trip member may be at least partially housed between the housing walls.

According to another advantageous embodiment of the latching apparatus according to the present invention, the trip member is rotatable about a second axis, and the trip member is adapted to rotate about the second axis between the third and fourth positions. By this embodiment, an efficient movement of the trip member and an efficient release of the first member from the first positions are provided. Alternatively, the trip member may be moved along an axis between the third and fourth positions. Various designs of the trip member are possible, and some alternatives are shown in the detailed description of embodiments.

According to yet another advantageous embodiment of the latching apparatus according to the present invention, the first axis and the second axis are substantially parallel to one another. By this embodiment, a compact design of the latching apparatus is provided.

According to still another advantageous embodiment of the latching apparatus according to the present invention, the latching apparatus comprises an actuator adapted to move the trip member from the third position to the fourth position. The actuator may be an electrically operated actuator or an electromagnetic actuator, which may have an actuator coil. However, other actuators are possible. Various sorts of actuators are known to the person skilled in the art. The trip member may be a separate part in relation to the actuator, and the actuator may have an operating arm, e.g. a swivel arm, adapted to control, e.g. push, the trip member. Alternatively, the trip member may be mounted to the actuator and the trip member may form the operating arm of the actuator. Other designs are also possible.

According to an advantageous embodiment of the latching apparatus according to the present invention, the latching apparatus comprises first reset means adapted to move the first member from the second position to the first position. By the present invention, the reset of the latching apparatus after a release of the drive member, to the initial state when the drive member is locked by the first member, is easily performed and made less complicated, where the uncomplicated reset of the first member to the first position is part of the reset of the latching apparatus. The first reset means may comprise first biasing means. The first biasing means may comprise a spring. By means of biasing means, e.g. a spring, the first member is efficiently reset to its first position. However, other reset means are possible.

According to a further advantageous embodiment of the latching apparatus according to the present invention, the latching apparatus comprises second reset means adapted to move the trip member from the fourth position to the third position. By the present invention, the reset of the latching apparatus after a release of the drive member, to the initial state when the drive member is locked by the first member, is easily performed and made less complicated, where the uncomplicated reset of the trip member to the third position is part of the reset of the latching apparatus. The second reset means may comprise second biasing means. The second biasing means may comprise a spring. By means of biasing means, e.g. a spring, the trip member is efficiently reset to its third position. However, other reset means are possible.

According to another advantageous embodiment of the latching apparatus according to the present invention, the first member has an outer surface which comprises a fourth surface portion that is concave. By this embodiment, the first member is provided with an efficient shape that facilitates the guiding of the first member. Advantageously, the fourth surface portion may be adapted to receive at least a portion of the trip member when the trip member is moved from the third position to the fourth position. When the trip member is in the fourth position, the trip member may be adapted to rest against the fourth surface portion. The fourth surface portion may form a recess together with two side walls, and when the trip member is in the fourth position, at least a portion of the trip member may be adapted to engage said recess. By this embodiment, an improved control of the trip member is provided.

At least one the above-mentioned objects of the present invention is also attained by an operating mechanism for an electrical switching apparatus, the operating mechanism being operatively connectable to the switching apparatus, and the operating mechanism comprises a latching apparatus and a drive member movable in relation in the latching apparatus between at least one locked position and at least one released position, wherein the latching apparatus comprises the features of any of the above-mentioned embodiments of the latching apparatus. Positive technical effects of the operating mechanism according to the present invention, and its embodiments, correspond to the above-mentioned technical effects mentioned in connection with the latching apparatus according to the present invention, and its embodiments. When the switching apparatus comprises a mobile or movable contact movable in relation to another contact, as mentioned above, the operating mechanism may be operatively connectable to the movable contact of the switching apparatus.

The above-mentioned object of the present invention may also be attained by an electrical switching apparatus comprising the above-mentioned operating mechanism. The electrical switching apparatus may have at least two contacts movable in relation to one another, and the operating mechanism may be operatively connected to a movable contact of said at least two contacts of the switching apparatus.

The above-mentioned features and embodiments of the latching apparatus and the operating mechanism, respectively, may be combined in various possible ways providing further advantageous embodiments.

Further advantageous embodiments of the latching apparatus and the operating mechanism, respectively, according to the present invention and further advantages with the present invention emerge from the detailed description of embodiments.

BRIEF DESCRIPTION OF THE DRAWINGS

The present invention will now be described, for exemplary purposes, in more detail by way of embodiments and with reference to the enclosed drawings, in which.

DETAILED DESCRIPTION OF THE INVENTION

Figure 1:
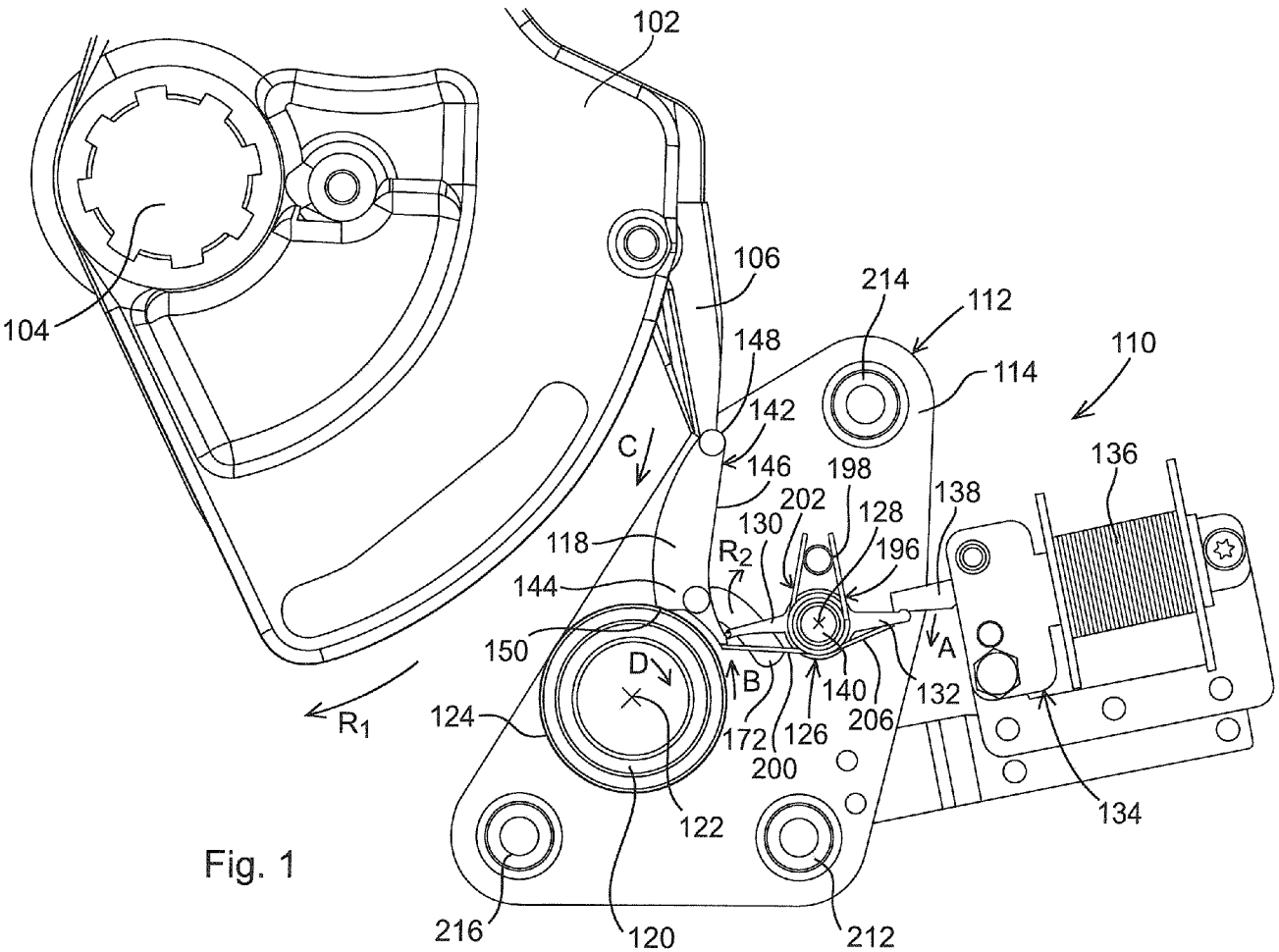
FIG. 1 is a schematic side view of a first embodiment of the latching apparatus according to the present invention and also of a part of an embodiment of the operating mechanism according to the present invention, where a drive member of the operating mechanism is in a locked position.

FIG. 1 schematically shows a part of an embodiment of the operating mechanism for an electrical switching apparatus according to the present invention, the operating mechanism being operatively connectable to the switching apparatus. The operating mechanism may comprise a drive unit 102 which in turn may comprise a rotary drive shaft 104 arranged to transmit an actuating movement to the switching apparatus, e.g. to a mobile contact of the switching apparatus, e.g. via a mechanical structure known to the skilled person. The mobile contact may be movable to another contact to open and close, respectively, a current path. The drive unit 102 may be provided with a drive member 106, which may be mounted to the drive unit 102 via a pivot axis 108. The drive unit 102 may comprise biasing means, e.g. a loaded torsion spring, which forces the drive unit 102 and the drive member 106 in a first direction of rotation $R_1$ about the rotary drive shaft 104.

Further, the operating mechanism is provided with a first embodiment of the latching apparatus 110 according to the present invention, which is also schematically shown in FIG. 1. The latching apparatus 110 may comprise a housing 112 which may have two walls 114, 116. In FIGS. 1-7, only one wall 114 is shown, whereas the second wall 116 is removed for illustrative purposes. The latching apparatus 110 comprises a first member 118 movable between at least one first position and at least one second position.

In the first position the first member 118 is adapted to lock the drive member 106 of the operating mechanism in a locked position. In FIG. 1, the first member 118 is in the first position and the drive member 106 is in a locked position and blocked or locked by the first member 118. Thus, the drive member 106 is prevented from rotating in the first direction of rotation $R_1$ by its contact with the first member 118 and a force of the drive member 106 is applied to the first member 118. As the drive member 106 is prevented from moving in the first direction of rotation $R_1$, the drive unit 102 is also prevented from rotating in the first direction of rotation $R_1$.

Figure 2:
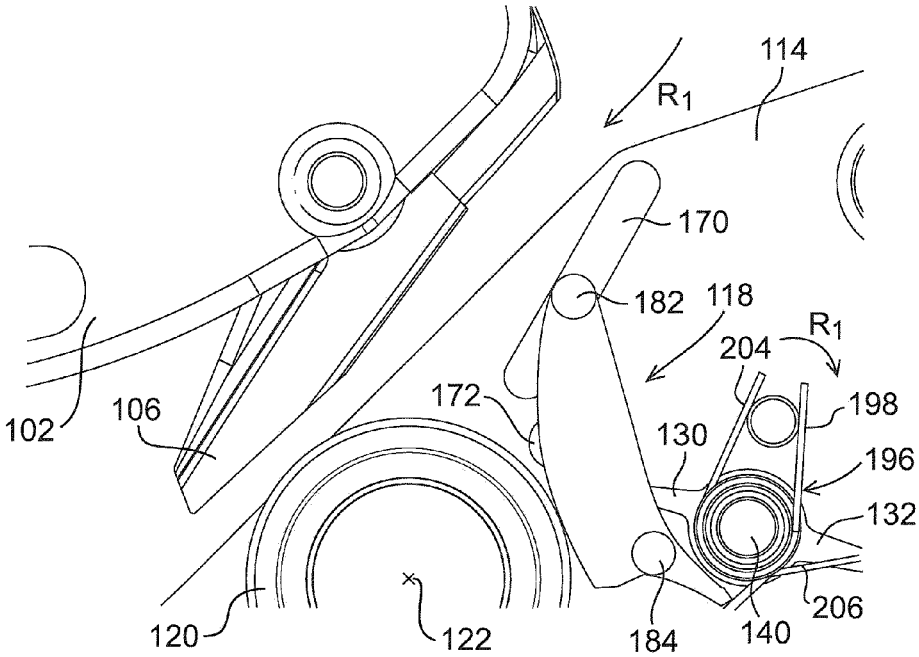
FIG. 2 is a schematic partial side view of the latching apparatus and of the operating mechanism of FIG. 1, but where the drive member is in released a position.
Figure 3:
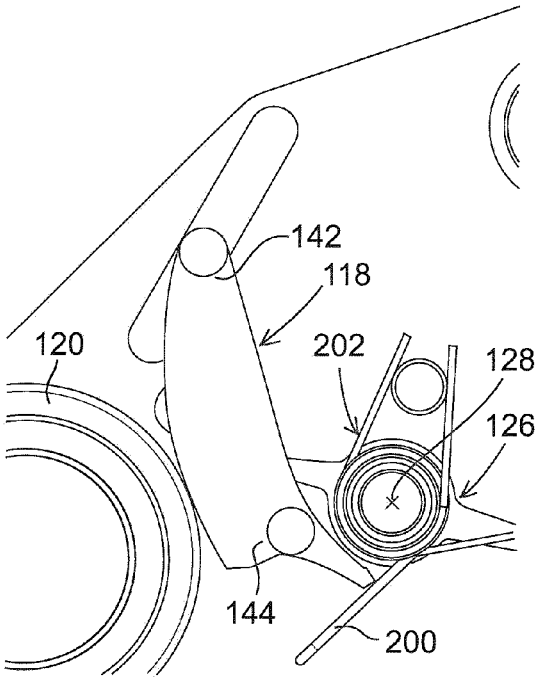
FIG. 3 is an enlarged view of details of FIG. 2.

In the second position the first member 118 is adapted to release the drive member 106 from the locked position. In FIGS. 2-3, the first member 118 is in the second position and the drive member 106 is in a released position and has been un-locked by the first member 118. The first member 118 may be adapted to be positioned a plurality of second positions, which is generally the case. Thus, the drive member 106 is allowed to rotate in the first direction of rotation $R_1$, and as the drive member 106 is allowed to rotate in the first direction of rotation $R_1$, the drive unit 102 is also allowed to rotate in the first direction of rotation $R_1$, and consequently, the rotary drive shaft 104 may be allowed to rotate about its axis and thereby transmit an actuating movement to the to the switching apparatus.

The latching apparatus 110 comprises a counter roller 120 defining a first axis 120, and at least in the first position the first member 118 is adapted to bear against the counter roller 120, i.e. the first member 118 is adapted to press against the counter roller 120, as illustrated in FIG. 1. The counter roller 120 may be rotatable about the first axis 122 and may have a circumferential outer surface 124, and at least in the first position the first member 118 may be adapted to bear against the outer surface 124 of the counter roller 118. The counter roller 120 may be pivotally attached to the housing 112, e.g. via a bearing, e.g. a cylinder roller bearing or a needle bearing. The latching apparatus 110 comprises a trip member 126 movable between at least one third position and at least one fourth position. In the third position the trip member 126 is adapted to lock the first member 118 in the first position, and in the fourth position the trip member 126 is adapted to release the first member 118 from the first position. In FIG. 1, the trip member 126 is in the third position and is locking the first member 118 in the first position. In FIGS. 2-3, the trip member 126 is in the fourth position and the first member 118 is released from the first position. The trip member 126 may be rotatable about a second axis 128, and the trip member 126 may be adapted to rotate about the second axis 128 between the third and fourth positions. The first axis 122 and the second axis 128 may be substantially parallel to one another. The trip member 126 may be adapted to lock the first member 118 in the first position by bearing against the first member 118. The trip member 126 may comprise a first leg 130 and a second leg 132. The first leg 130 may be adapted to bear against or abut the first member 118 when the trip member 126 is in the third position. The latching apparatus 110 may include an actuator 134 adapted to move the trip member 126 from the third position to the fourth position. The actuator 134 may be an electrically operated actuator or an electromagnetic actuator, which may have an actuator coil 136. The actuator 134 may have an operating arm 138, e.g. a swivel arm, adapted to control the trip member 126 by pushing the second leg 132 of the trip member 126, substantially downward in FIG. 1, and thus causes the first leg 130 to rotate about the second axis 128 in a second direction of rotation $R_2$. The trip member 126 may be pivotally mounted to the housing 112 via a shaft or pin 140, which defines the second axis 128, in some cases also via a bearing.

Figure 8:
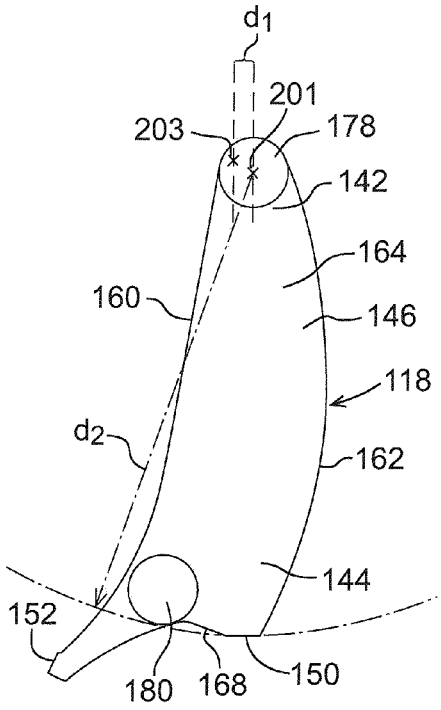
FIG. 8 is a schematic side view of the first member shown in FIG. 1.
Figure 9:
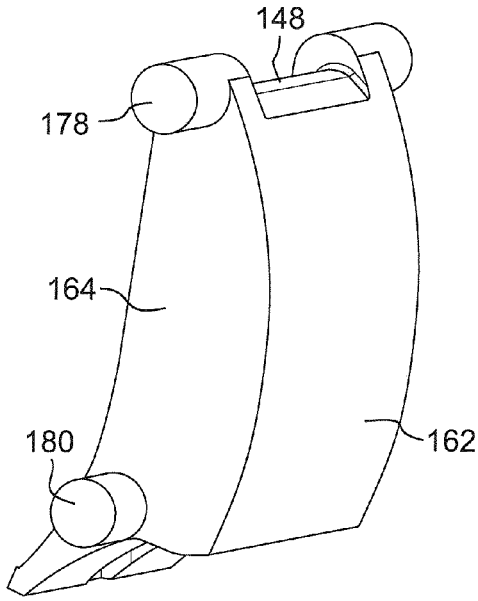
FIG. 9 is a schematic perspective front view of the first member shown in FIG. 8.
Figure 10:
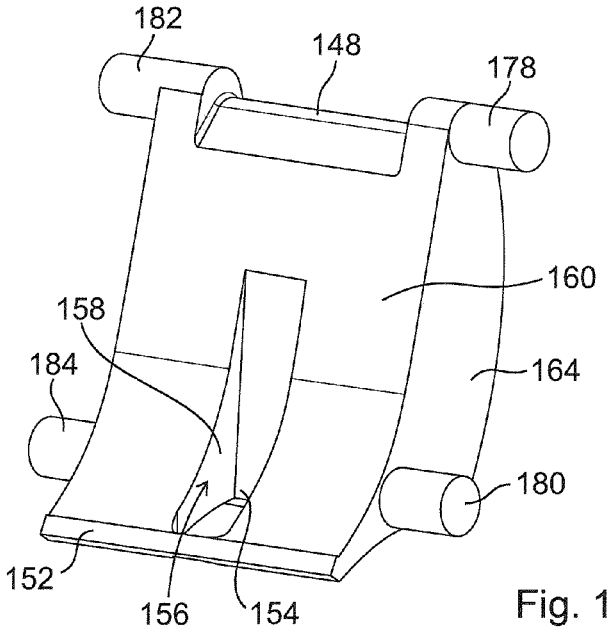
FIG. 10 is a schematic perspective rear view of the first member shown in FIG. 8.

With reference to FIGS. 8-10, the first member 118 comprises a first portion 142 and a second portion 144. The first member 118 may be made of a material having satisfactory properties, e.g. a metal, a resistant polymer etc. The first member 118 has an outer surface 146, and the outer surface 146 may comprise a first surface portion 148. When the first member 118 is in the first position, the first surface portion 148 is adapted to bear against the drive member 106. The first portion 142 of the first member 118 may comprise the first surface portion 148. The first surface portion 148 may be convex. The outer surface 146 of the first member 118 may comprise a second surface portion 150. When the first member 118 is in the first position, the second surface portion 150 is adapted to bear against the outer surface 124 of the counter roller 120. The second portion 144 of the first member 118 may comprise the second surface portion 150, and the second surface portion 150 may be convex. The outer surface 146 of the first member 118 may comprise a third surface portion 152, and the trip member 126 may be adapted to lock the first member 118 in the first position by bearing against the third surface portion 152. The second portion 144 of the first member 118 may comprise the third surface portion 152. The outer surface 146 of the first member 118 may comprise a fourth surface portion 154 that is concave. The fourth surface portion 154 may form a recess 156 together with two side walls 158 (only one shown), and when the trip member 126 is in the fourth position, at least a portion of the first leg 130 of the trip member 126 may be adapted to engage said recess 156. Further, the first member 118 may have a rear wall 160, which may be concave, and a front wall 162, which may be convex, and two side walls 164, 166 connecting to the rear wall 160 and front wall 162 to one another, and a bottom wall 168, which may be concave. The recess 156 may be provided in the rear wall 160. In a plane that is perpendicular to the first axis 122 of the counter roller 120, the first member 118 may form an elongated cross-section. In a plane that is perpendicular to the first axis 122 of the counter roller 120, the first member 118 may form a non-circular cross-section. In a plane that is perpendicular to the first axis 122 of the counter roller 120, the distance between the first and second surface portions 148, 150 may exceed the distance between the rear and front walls 160, 162 of the first member 118.

In the first position, as shown in FIG. 1, the first member 118 is adapted to distribute the force of the drive member 106, applied to the first member 118, to a first force component applied to the counter roller 120 and a second force component applied to the trip member 126. The force, or load, of the drive member 106 does not exactly press in the direction to the first axis 122, or centre, of the counter roller 120, but there is a defined (small) deviation to cause/support the movement of the first member 118 in the direction toward the third surface portion 152 when the trip member 126 has released the first member 118.

The latching apparatus 110 comprises guiding means for guiding the movement of the first member 118, and the guiding means are adapted to guide the movement of the first member 118 in relation to the counter roller 120. The force that moves the first member 118 and allows for the guiding means to guide the movement of the first member originates from the force of the drive member 106. When guiding the first member 118 from the first position to the second position, the guiding means are adapted to guide at least the first portion 142 of the first member 118 in a first direction toward the counter roller 122, and the first direction may be substantially toward the first axis 122 of the counter roller 120. When guiding the first member 118 from the first position to the second position, the guiding means may be adapted to guide the first portion 142 of the first member 118 in the first direction so that the distance between the first surface portion 148 of the first member 118 and the first axis 122 is reduced. In accordance with the herein illustrated embodiments of the latching apparatus 110, when guiding the first member 118 from the first position to the second position, the guiding means are adapted to guide the second portion 144 of the first member 118 in a second direction different from the first direction, and the second direction may be substantially parallel to or substantially the same as the direction of the second force component. The first member 118 is configured to be guided as disclosed above.

The guiding means and the first member 118 may be configured such that the magnitude of the second force component is less than 2% of the magnitude of the force of the drive member 106 applied to the first member 118. The guiding means and the first member 118 may be configured such that the magnitude of the second force component is about 1% of the magnitude of the force of the drive member 106 applied to the first member 118.

With reference to FIGS. 1-3 and 6-10, aspects of the guiding means will now be described in more detail. The guiding means comprise two guiding sets which may be opposite to one another. The first wall 114 of the housing 112 and the first side wall 164 of the first member 118 may be provided with a first guiding set and the second wall 116 of the housing 112 and the second side wall 166 of the first member 118 may be provided with a second guiding set. Each guiding set may comprise two guiding slots 170, 172, 174, 176 and two guiding members 178, 180, 182, 184 each engaging one of the guiding slots 170, 172, 174, 176. Each guiding member 178, 180, 182, 184 may comprise a pin defining an axis. The two guiding slots 170, 172, 174, 176 of the same guiding set may also be connected to one another to form a single guiding slot. Each guiding member 178, 180, 182, 184 is movable in relation its guiding slot 170, 172, 174, 176, and may rotate about its axis in relation to its guiding slot 170, 172, 174, 176. With reference to FIGS. 8-10, the first member 118 may be provided with the guiding members 178, 180, 182, 184 of both guiding sets, and the guiding members 178, 180, 182, 184 may be integrally formed with the first member 118 or attached to the first member 118 by means of attachment, e.g. threads, welding etc. Alternatively, two guiding members may be formed by a single rod inserted into a through-hole of the first member and extending on each side of the first member. A first guiding member 178, 182 of each guiding set may be attached to the first portion 142 of the first member 118 and a second guiding member 180, 184 of each guiding set may be attached to the second portion 144 of the first member 118. The first and second guiding members 178, 180, 182, 184 of the same guiding set may be spaced apart by a space. The first guiding members 178, 182 may be positioned opposite one another and their axis may be aligned. The second guiding members 180, 184 may be positioned opposite one another and their axis may be aligned. The first wall 114 of the housing 112 may define the guiding slots 170, 172 of the first guiding set, and the second wall 116 of the housing 112 may define the guiding slots 174, 176 of the second guiding set. A first guiding slot 170, 174 of each guiding set may be engaged by the first guiding member 178, 182, and a second guiding slot 172, 176 of each guiding set may be engaged by the second guiding member 180, 184.

Figure 6:
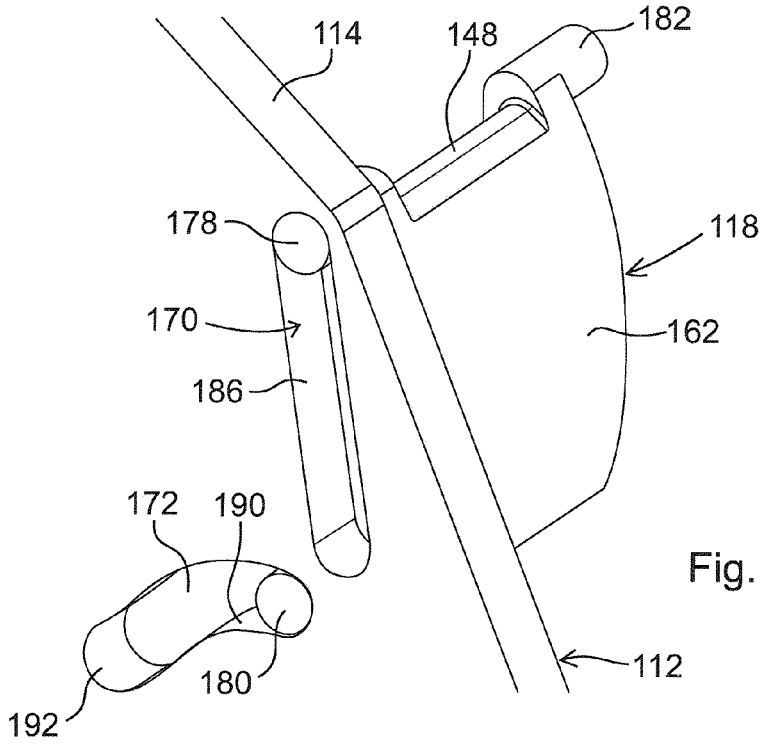
FIG. 6 is a schematic partial perspective view showing the first member of the latching apparatus of FIG. 1 in a first position when locking the drive member.
Figure 7:
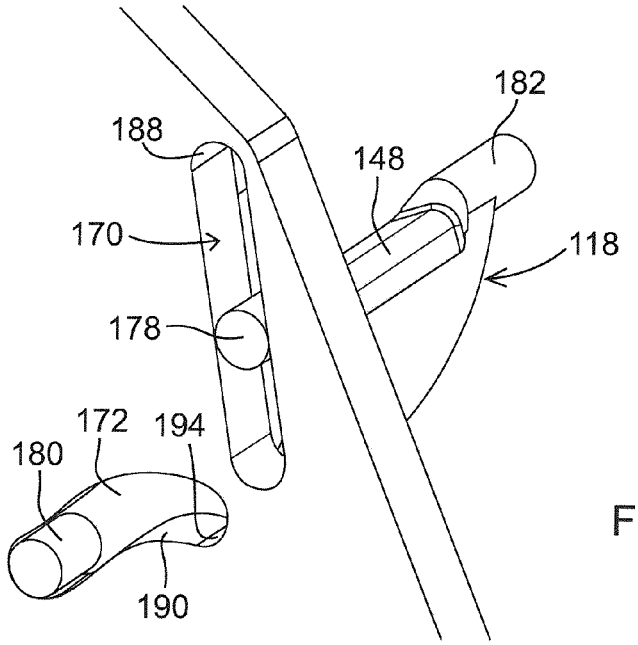
FIG. 7 is a schematic partial perspective view showing the first member of the latching apparatus of FIG. 1 in a second position when the drive member is released.

With reference to FIGS. 6-7 showing the first guiding set, where the first member 118 is in the first position in FIG. 6 and in the second position in FIG. 7, the first guiding slot 170 may be formed by a first inner wall 186 of the first housing wall 114 and the first inner wall 186 may include a first stop 188 for restricting the movement of the first guiding member 178 away from the counter roller 120. With reference to FIGS. 2-3, the first guiding slot 170 may have a longitudinal extension in the direction toward the counter roller 120 and/or substantially toward the first axis 122 of the counter roller 120. The second guiding slot 172 may be formed by a second inner wall 190 of the first housing wall 114 and the second inner wall 190 may include a second stop 192 for restricting the movement of the second guiding member 180 in a direction away from the first stop 188 and a third stop 194 for restricting the movement of the second guiding member 180 in a direction toward the first guiding slot 170. With reference to FIGS. 6-7, the second guiding slot 172 may have a longitudinally curved extension that curves about the first axis 122 of the counter roller 120. The first and second guiding slots 178, 180 of the first guiding set may be spaced apart by the first housing wall 114. The second guiding slot 172 may have a longitudinally extension that forms at least one angle with a longitudinal extension of the first guiding slot 170. However, the guiding slots may have other shapes. The structure of the guiding slots 174, 176 of the second guiding set may correspond to the guiding slots 170, 172 of the first guiding set.

Initially, as shown in FIG. 1, the drive member 106 is locked in a locked position by the first member 118, which is in the first position, and the trip member 126 is in the third position locking the first member 118 in the first position. With reference to FIG. 1, to operate the drive unit 102, the following steps occur: Firstly, a control signal may be applied to actuator 134 and the operating arm 138 moves in the direction of arrow A, pushing the second leg 132 of the trip member also in the direction of arrow A, and the trip member 126 is forced to rotate in the second direction of rotation $R_2$ about the second axis 128. The rotation of the trip member 126 in the second direction of rotation $R_2$ moves the first leg 130 in the direction of arrow B, and consequently, moves the trip member 126 from the third position to the fourth position. The first leg 130 leaves the abutment with the third surface portion 152 and a part of the first leg engages and slides along the recess 156. Thus, the first member 118 is released and no longer blocked by the trip member 126, and the force of the drive member 106 pushes the first portion 142 of the first member 118 substantially toward the first axis 122 of the counter roller 120, in the direction of arrow C, and also pushes the second portion 144 of the first member 118 substantially in the second direction that is substantially parallel to or substantially the same as the direction of the second force, in the direction of arrow D, and in this embodiment substantially toward the second axis 128 of the trip member 126. Consequently, the guiding means guides the first member 118 from the first position (in FIG. 1 substantially downward) and the drive member 106 is released from the locked position and may turn about its pivot axis 108 and may rotate together with the drive unit 102 in the first direction of rotation $R_1$. In FIG. 2, the first member 118 has been guided to the at least one second position and the drive member 106 is shown rotating. The release steps as disclosed above may be performed during one or a few milliseconds. After a rotation, the drive member 106 is returned to the first member 118, e.g. by means of an electric motor, or a spring etc., to again be locked by the first member 118. The latching apparatus 110 is reset by resetting the first member 118 to the first position and by resetting the trip member 126 to the third position, as disclosed hereinafter, and the latching apparatus 110 is prepared for the next operation sequence.

With reference to FIGS. 1 and 3, the latching apparatus 110 may comprise first reset means adapted to move the first member 118 from the second position to the first position. The first reset means may comprise first biasing means including a first spring 196, e.g. a helical torsion spring, which may be provided around the second axis 128 of the trip member 126, and the first spring 196 may have one leg 198 bearing against the housing 112 and another leg 200 bearing against the first member 118, e.g. against the second portion 144 of the first member 118. The latching apparatus 110 may comprise second reset means adapted to move the trip member 126 from the fourth position to the third position. The second reset means may comprise second biasing means including a second spring 202, e.g. helical torsion spring, which may be provided around the second axis 128 of the trip member 126, and the second spring 202 may have one leg 204 bearing against the housing 112 and another leg 206 bearing against the trip member 126, e.g. against the second leg 132 of the trip member 126. The first reset means may force the trip member 126 to rotate in the direction opposite to the second direction of rotation $R_2$ to return the trip member 126 to the third position. Alternatively, the first and second spring 196, 202 may be replaced by one single spring. Other reset means may be used. Other biasing means may used. Other springs may be used, e.g. other torsion springs, e.g. a torsion bar etc. The counter roller 120 does not need to be reset. Thus, only the first member 118 and the trip member 126 need to be reset. This improves mechanical re-initialization and provides for lower scatter in the reaction and operation time of the latching apparatus 110 which contributes to a higher reliability of the overall operating mechanism.

With reference to FIG. 8, the first guiding member 178 may rotate about its axis 201 in relation to the first guiding slot 170. Thus, the first member 118 may rotate about the axis 201 of the first guiding member 178. When the first member 118 is in the first position, the contact between the first surface portion 148 of the first member 118 and the drive member 106 may be positioned at 203 and may be displaced by a distance $d_1$ in relation to the axis 201 of the first guiding member 178. Thus, the force of the drive member 106 applied to the first member 118 is also displaced by the distance $d_1$ in relation to the axis 201 of the first guiding member 178. By said displacement $d_1$, a moment is generated about the axis 201 of the first guiding member 178. The first force between the first member 118 and the outer surface 124 of the counter roller 120 is directed through the axis 201 of the first guiding member 178, and does not generate any moment about said axis 201. The moment generated about said axis 201 generates said second force and is balanced by the contact between the first member and the first leg 130 of the trip member 126 when the first member 118 is in the first position.

To support the return of the trip member 126 to the third position and to satisfactory lock the first member 118 in the first position, a play may be provided between the first member 118 and the first leg 130 of the trip member 126 upon the return of the trip member 126 to the third position. To provide said play, the first member 118 may have a geometric shape that allows the first member 118 to move without changing the direction of the force between the outer surface 124 of the counter roller 120 and the first member 118 at the second surface portion 150. The second surface portion 150 may be curved about the axis 201 of the first guiding member 178 and may form an arc in relation to the axis 201 of the first guiding member 178 in a plane that is perpendicular to the first axis 122 of the counter roller 120. Consequently, the contact between the first member 118 and the outer surface 124 of the counter roller 120 may be unchanged at the second surface portion 150 when the first member 118 rotates about the axis 201 of the first guiding member 178. The first guiding slot 170 may be configured such that the first member 118 is adapted to be rotated about the axis 201 of the first guiding member 178 when the second portion 144 of the first member 118 is guided in the direction of the second guiding slot 172. By the non-circular shape of the first member 118, as shown in FIG. 8, the drive member 106 may pass the first member 118 after being released from the locked position without being hindered by the first member 118. The weight of the first member 118 may be reduced in relation to prior art, reducing the inertia of the first member 118, and a shorter reaction/latching time is attained. By the innovative shape of the first member 118, a large distance $d_2$ between the axis 201 of the first guiding member 178 and the second surface portion 150 may be provided, and larger dimensions may make the latching apparatus less sensitive to manufacturing variations. By the innovative shape of the first member 118 and the guiding means, the latching apparatus is less sensitive to any variations in the contact between the first member 118 and the trip member 126. By the innovative shape of the first member 118 and the guiding means, the contact between the first member 118 and the drive member 106 and the contact between the first member 118 and the trip member 126 may be efficiently controlled.

Figure 4:
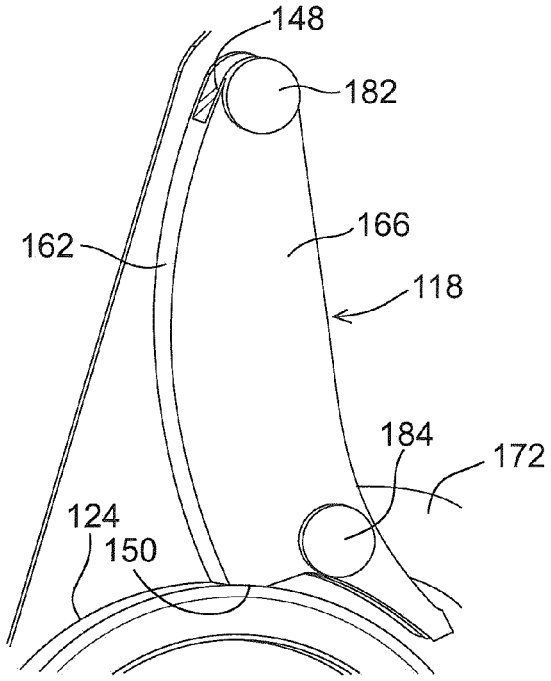
FIG. 4 is a schematic perspective view of the first member of the latching apparatus of FIG. 1, when the first member is locking the drive member in the locked position.

FIG. 4 schematically shows the first member 118 in the first position, when the second surface portion 150 bears against the outer surface 124 of the counter roller 120.

Figure 5:
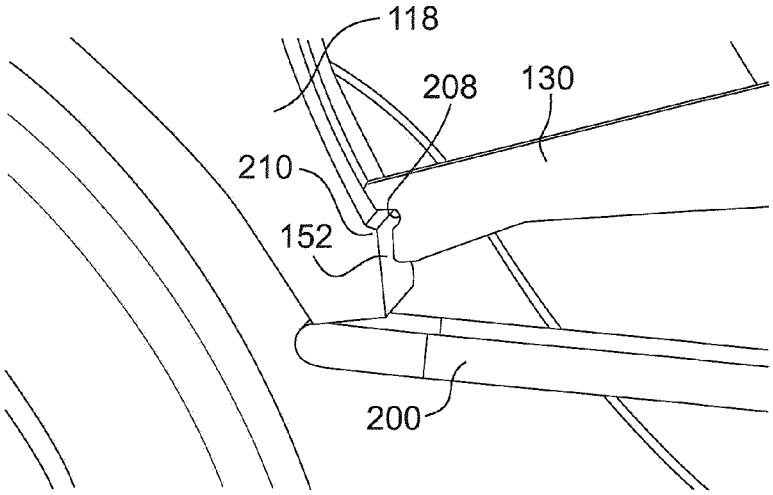
FIG. 5 is an enlarged view of details of FIG. 1.

FIG. 5, where the trip member 126 is in the third position and the first member 118 is in the first position, schematically shows that the first leg 130 of the trip member 126 and the third surface portion 152 of the first member 118 may be provided with complementary engagement means to support the bearing of the trip member 126 against the third surface portion 152 and thus support a more secure locking of the first member 118 in the first position. The complementary engagement means may comprise a groove 208 on the first leg 130 and a protrusion 210 on the first member 118, or vice versa, the protrusion 210 being adapted to engage the groove 208. However, the complementary engagement means may be excluded. How one of the legs 200 of the first spring 196 may bear against the first member 118 is also illustrated more in detail in FIG. 5.

Figure 11:
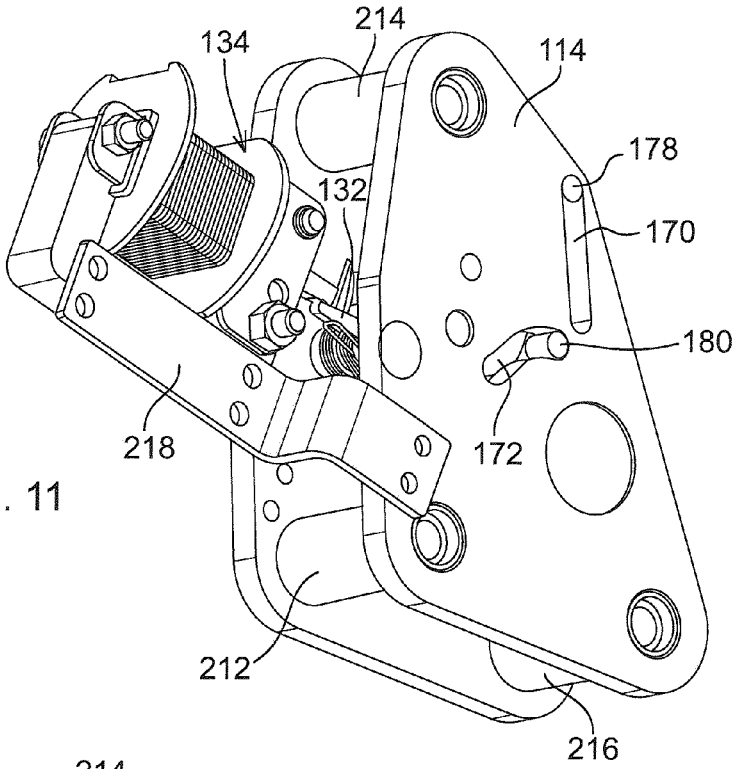
FIG. 11 is a schematic perspective rear view of the latching apparatus of FIG. 1 when the first member is in the first position.
Figure 12:
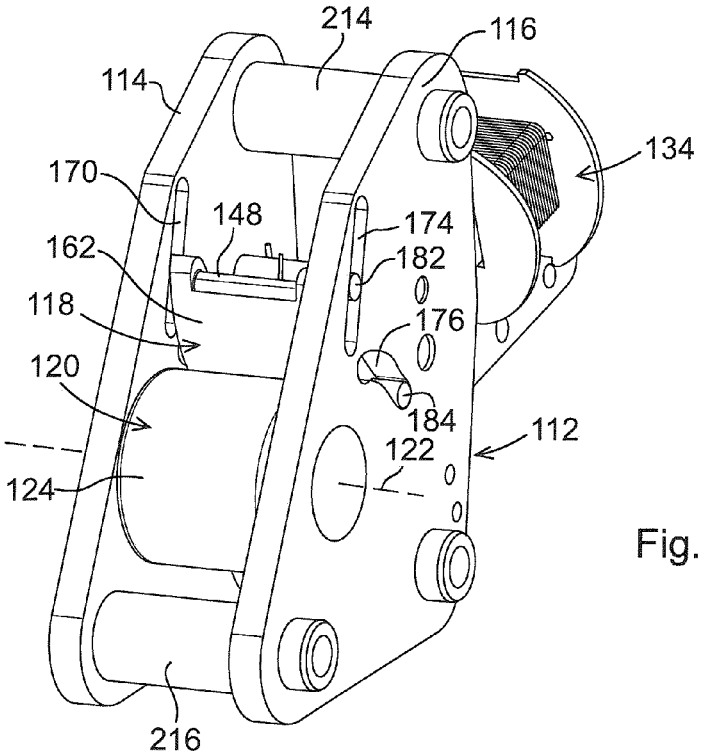
FIG. 12 is a schematic perspective front view of the latching apparatus of FIG. 1 when the first member is in the second position.

With reference to FIGS. 11-12, both of the first and second walls 114, 116 of the housing 112 are shown. The housing 112 may comprise a plurality of spacers, e.g. three spacers 212, 214, 216, for mounting the two housing walls 114, 116 to one another. The actuator 134 may be mounted to the housing 112 by means of a mounting element 218 attached to the actuator 134 and to one of the walls 114 of the housing 112. The first member 118, the counter roller 120 and/or the trip member 126 may be at least partially housed between the housing walls 114, 116.

Figure 13:
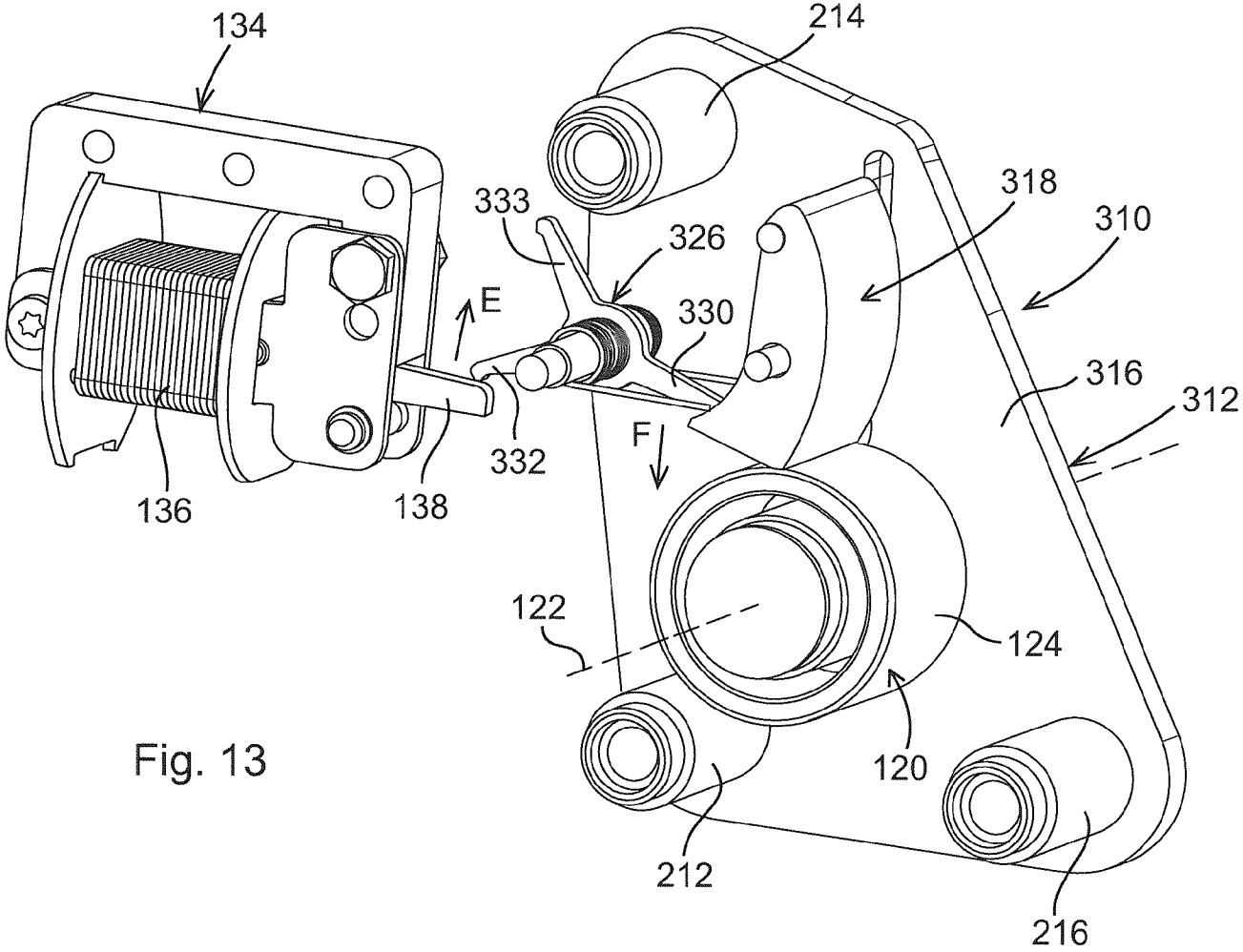
FIG. 13 is a schematic perspective front view of a second embodiment of the latching apparatus according to the present invention.

FIG. 13 schematically shows a second embodiment of the latching apparatus 310 according to the present invention, having a differently designed trip member 326 and a slightly modified first member 318 in relation to the first embodiment of the latching apparatus 110 disclosed above. The trip member 326 of the second embodiment has three legs 330, 332, 333 instead of two legs. The third leg 333 of the trip member 326 may be associated with a second actuator (not shown) for back-up and safety reasons. The second actuator may operate in a corresponding way as the first actuator 134. In FIG. 13, the actuator 134 has been turned approximately 180 degrees about the axis of the coil 136 in relation to the position of the actuator 134 of the first embodiment of the latching apparatus 110. The operating arm 138 of the actuator 134 is adapted to control the trip member 326 by pushing the second leg 332 of the trip member 326, substantially upward in FIG. 13, as indicate by arrow E, and thus causes the first leg 330 to rotate about the second axis 128 in a third direction of rotation $R_3$, and the first leg 330 is moved in a direction indicated by arrow F to the fourth position. The modified first member 318 substantially corresponds to the first member 118 of the first embodiment, but has a slightly modified shape.

The main energy to drive the latching apparatus 110, 310 and its different stages is not provided by the actuator 134 but by the energy stored in the operating mechanism. With the exception of the first member 118, standard parts (off the shelf parts) may be used for the components of the latching apparatus. The first member 118 may be made by casting, machining or cutting. The housing walls 114, 116 may be made of a metal, a resistant polymer, or any other suitable material. The trip member 126 may be made by casting, machining or cutting, and may be made of a material having satisfactory properties, e.g. a metal, a resistant polymer etc.

The invention shall not be considered limited to the embodiments illustrated, but can be modified and altered in many ways by one skilled in the art, without departing from the scope of the appended claims.

What is claimed is:

1. A latching apparatus for an operating mechanism for an electrical switching apparatus, the operating mechanism being operatively connectable to the switching apparatus, the latching apparatus comprising a first member movable between at least one first position and at least one second position, in the first position the first member being adapted to lock a drive member of the operating mechanism in a locked position and a force of the drive member being applied to the first member, and in the second position the first member is adapted to release the drive member from the locked position, a counter roller defining a first axis, at least in the first position the first member being adapted to bear against the counter roller, guiding means for guiding the movement of the first member, the guiding means being adapted to guide the movement of the first member in relation to the counter roller, and a trip member movable between at least one third position and at least one fourth position, in the third position the trip member being adapted to lock the first member in the first position, and in the fourth position the trip member is adapted to release the first member from the first position, and in the first position the first member is adapted to distribute the force of the drive member, applied to the first member, to a first force component applied to the counter roller and a second force component applied to the trip member, characterized in that when guiding the first member from the first position to the second position, the guiding means are adapted to guide at least a first portion of the first member in a first direction toward the counter roller.

2. The latching apparatus according to claim 1, characterized in that when guiding the first member from the first position to the second position, the guiding means are adapted to guide the first portion of the first member in the first direction that is substantially toward the first axis of the counter roller.

3. The latching apparatus according to claim 1, characterized in that the first member as an outer surface which comprises a first surface portion, in that when the first member is in the first position, the first surface portion is adapted to bear against the drive member, and in that the first portion of the first member comprises the first surface portion.

4. The latching apparatus according to claim 1, characterized in that when guiding the first member from the first position to the second position, the guiding means are adapted to guide at least a second portion of the first member in a second direction different from the first direction.

5. The latching apparatus according to claim 4, characterized in that when guiding the first member from the first position to the second position, the guiding means are adapted to guide the second portion of the first member in the second direction that is substantially parallel to or substantially the same as the direction of the second force component.

6. The latching apparatus according to claim 4, characterized in that the first member as an outer surface which comprises a second surface portion, in that when the first member is in the first position the second surface portion is adapted to bear against the counter roller, and in that the second portion of the first member comprises the second surface portion.

7. The latching apparatus according to claim 4, characterized in that the first member has an outer surface which comprises a third surface portion, in that the trip member is adapted to lock the first member in the first position by bearing against the third surface portion of the first member, and in that the second portion of the first member comprises the third surface portion.

8. The latching apparatus according to claim 1, characterized in that the guiding means and the first member are configured such that the magnitude of the second force component is less than 10% of the magnitude of the force of the drive member applied to the first member.

9. The latching apparatus according to claim 1, characterized in that the guiding means comprise at least one guiding set comprising at least one guiding slot and at least one guiding member engaging the at least one guiding slot, and in that the at least one guiding slot and the at least one guiding member are movable in relation to one another.

10. The latching apparatus according to claim 9, characterized in that the guiding set comprises two guiding members that are spaced apart.

11. The latching apparatus according to claim 9, characterized in that the latching apparatus comprises a housing, in that the first member is provided with the at least one guiding member, and in that the housing defines the at least one guiding slot.

12. The latching apparatus according to claim 1, characterized in that the trip member is rotatable about a second axis, and in that the trip member is adapted to rotate about the second axis between the third and fourth positions.

13. The latching apparatus according to claim 1, characterized in that the latching apparatus comprises an actuator adapted to move the trip member from the third position to the fourth position.

14. The latching apparatus according to claim 1, characterized in that the first member has an outer surface which comprises a fourth surface portion that is concave.

15. An operating mechanism for an electrical switching apparatus, the operating mechanism being operatively connectable to the switching apparatus, and the operating mechanism comprises a latching apparatus and a drive member movable in relation in the latching apparatus between at least one locked position and at least one released position, characterized in that the latching apparatus comprises the latching apparatus according to claim 1.

* * * * *